United States Patent [19]

Cassai

[11] 4,165,755

[45] Aug. 28, 1979

[54] ADJUSTABLE MASCARA WAND

[76] Inventor: Gino H. Cassai, 924 E. 96th St., Brooklyn, N.Y. 11236

[21] Appl. No.: 836,923

[22] Filed: Sep. 26, 1977

[51] Int. Cl.[2] ..... A45D 40/26

[52] U.S. Cl. ..... 132/88.7

[58] Field of Search ..... 132/88.7, 88.5; 128/62 A; 63/29, 4, 81; 401/122, 126, 128; 15/167 R, 172

[56] References Cited

U.S. PATENT DOCUMENTS

| | | | |
|---|---|---|---|
| 430,909 | 6/1890 | Wonderly | 15/172 |
| 905,886 | 12/1908 | Kinney | 28/62 A |
| 1,369,664 | 2/1921 | Izawa | 15/172 |
| 2,749,567 | 6/1956 | Krueger | 15/172 |
| 3,084,374 | 4/1963 | Ziegler | 132/88.7 |
| 3,320,962 | 5/1967 | Moriber et al. | 401/31 |
| 3,469,928 | 9/1969 | Widegren | 401/122 |
| 3,861,810 | 1/1975 | Vasas | 401/122 |

*Primary Examiner*—G. E. McNeill

*Attorney, Agent, or Firm*—Sughrue, Rothwell, Mion, Zinn and Macpeak

[57] ABSTRACT

A mascara wand used with a container has a top for the container with an outwardly extending main shaft. A shaft extension is pivotally secured to the main shaft and carries the applicator bristles thereon. The top has indicia which show the direction of the pivot axis of the extension.

5 Claims, 7 Drawing Figures

FIG.1
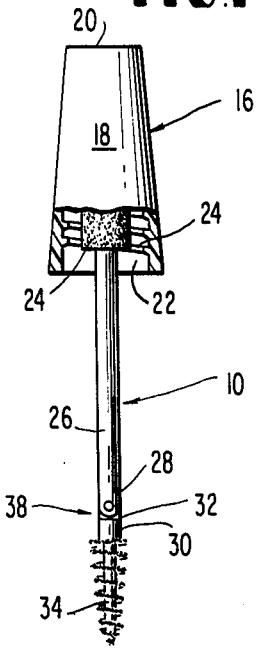
FIG.2
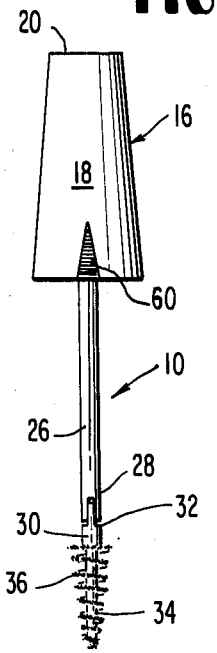
FIG.3
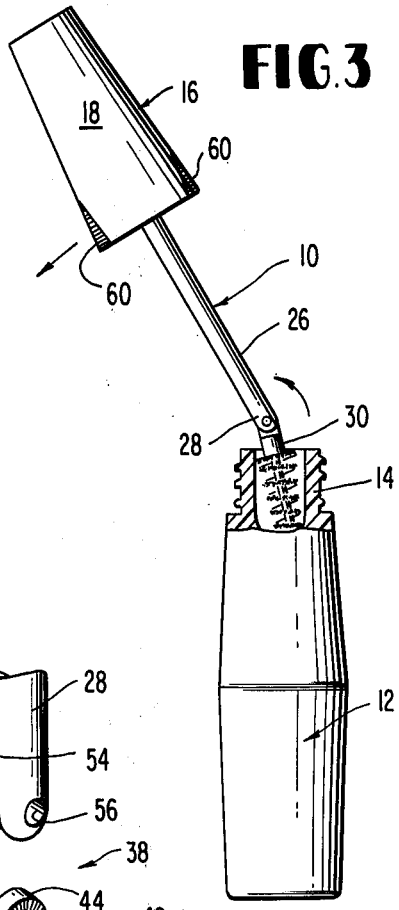
FIG.5
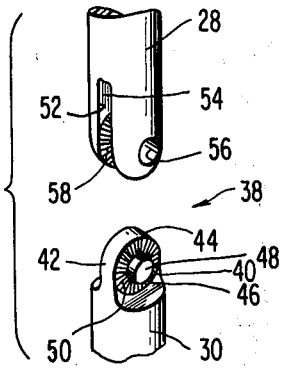
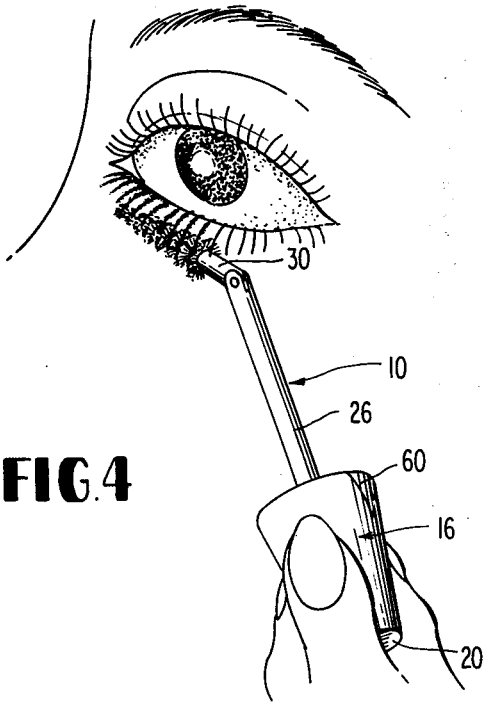
FIG.4
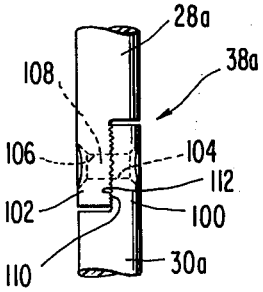
FIG.6
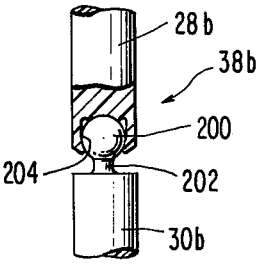
FIG.7

ADJUSTABLE MASCARA WAND

BACKGROUND OF THE INVENTION

1. Field of the Invention

This invention relates to cosmetic applicators, more specifically a device for applying mascara.

2. Statement of the Prior Art

Adjustable brushes have heretofore been known, as have bristle carrying mascara applicators. Examples of typical patents in this area are as follows:

| Patentee | Reg. No. | Date |
|---|---|---|
| T. G. Wonderly | 430,909 | June 24, 1890 |
| Kingsford | 3,998,235 | Dec. 21, 1976 |

SUMMARY OF THE INVENTION

The application of mascara involves the use of a bristle carrying wand or a brush which is employed to transfer the cosmetic from its container to the eyelash of the user. Normally the cosmetic is self applied. The present invention provides a wand which is attached to the closure for the container, and unlike conventional items of this nature, is optionally bendable. This feature eliminates the cumbersome application of mascara often encountered with conventional wands. The wand has a extension shaft section which carries the bristles, and is bendable in at least two directions thereby simplifying application of the cosmetic for either the right or left hand convenience of the user. Mascara is thereby rendered more easily applicable, and the possibilities of misapplication or inadvertent contact with the eye are minimized.

An important feature of this invention resides in the provision of means for bending of the wand without the necessity to touch the brush during the bending procedure.

The wand provided hereby has been found particularly advantageous in reaching the small lashes at the corner of the eye.

Other and further objects and advantages of the invention will become apparent to those skilled in the art from a consideration of the following specification when read in conjunction with the annexed drawing.

BRIEF DESCRIPTION OF THE DRAWING

FIG. 1 is a side elevational view of a mascara wand constructed in accordance with the teachings of this invention, partially broken away for disclosure of details;

FIG. 2 is a view similar to FIG. 1 but with the item rotated substantially 90 degree;

FIG. 3 is an enlarged view of the wand and container illustrating a bending operation thereof;

FIG. 4 is a perspective view of the wand in use;

FIG. 5 is a further enlarged perspective view, disassembled, of the pivot means of a first form of the invention;

FIG. 6 is a side view of a second embodiment; and

FIG. 7 is a side view, partially broken away, of a third embodiment.

DESCRIPTION OF THE PREFERRED EMBODIMENTS

Referring to the drawing in more detail, FIGS. 1 through 5 show a first form of mascara wand 10 hereof.

The wand is employed with a container 12 for the cosmetic, the container having an externally threaded top throat 14.

The wand 10 comprises a container top 16 having an outer shell 18, a top wall 20, and an inner wall 22. The inner wall 22 is provided with threads 24 for engagement with the threads on the throat 14 of the container, whereby the container top serves as the closure for the container 12 when not in use. An inner block 24 is secured to the top wall 20 and is spaced inwardly from the inner wall 22, to provide a stopper fitting within the throat 14.

An elongated, substantially cylindrical main shaft 26 projects from the block and outwardly from the top, the shaft having a distal end section 28 spaced outwardly thereof. An extension shaft 30 has a first end 32 and a reduced second end 34. Fixedly secured on the reduced second end are series of bristles 36 arranged in spiral formation and of gradually reduced extent.

The extension shaft 30 is pivotally secured to the main shaft by pivot means 38. In the first form of the invention this comprises a pivot block 40 extending from the first end 30 of the extension shaft. The pivot block has an outer wall 42 generally coincident with the end 30, a rounded upper wall 44 and side walls 46. On each of the side walls are outwardly extending stub axles 48 with a series of serrations 50 radially arranged about each on the side walls. The distal end section 28 of the main shaft has a vertically extending slot 52 formed therein, having slot side walls 54. Bearing openings 56 are formed in the slot side walls in substantially perpendicular intersecting relation to the slot, and the slot walls have serrations 58 radially disposed about the openings. The stub axles 48 seat in the bearing openings 56, with the serrations 50 and 58 interengaged. The shafts are formed of a semi-rigid plastic or the like so that the extension may be pivoted relative to the inner shaft.

The container top 18 has indicia 60 on diametrically opposite sides of its outer shell 18, indicating the pivot axis of the extension. Thus, referring to FIG. 3, the user may partially withdraw the item from the throat and use the bottle as a means for holding the extension shaft while it is pivoted against the resistence of the serrations to a desired angle of inclination.

FIG. 6 shows a first modified form of the pivot means designated **38*a* wherein the means comprises a first pivot extension 100 projecting from the first end 30*a* of the extension shaft. A mating second pivot extension 102 projects from the distal end section 28*a* of the main shaft, and the pivot extensions each have openings 104 and 106, respectively, formed therein. The openings are coaligned, and a pivot axle 108 extends therethrough. The abutting faces of the pivot extension have mating radial serrations 110, 112** thereon providing a series of stops for rotation of the shaft extension.

A third embodiment **38*b* of the pivot means is illustrated in FIG. 7 and comprises a spherical ball member 200 mounted on a stem 202 projecting from the end 30*b* of the extension shaft. The end section 28*b* of the main shaft has a corresponding socket 204** to receive the ball.

I claim:

1. A mascara wand for use with a mascara container having a threaded top throat, the mascara wand comprising:

a container top having an outer shell, a top wall, and an inner wall threaded to threadedly engage the top throat;

an inner block within said top and spaced inwardly from said inner wall;

an elongated main shaft projecting outwardly from said block, the main shaft having a distal end section spaced outwardly from said container top;

an extension shaft member having first and second ends and having bristles secured thereon in spiral arrangement from end-to end;

means pivotally securing the first end of the extension shaft to the main shaft;

the outer shell of the container top having indicia thereon to indicate at least one pivot axis of the extension shaft; and the indicia being aligned with the shaft, and the extension shaft member being pivotal on said pivot axis by withdrawal of the main shaft from the container and engagement of the extension shaft member against the top throat of the container.

2. The invention of claim 1, wherein:

said means pivotally securing the first end of the extension shaft to the main shaft comprises a pivot block extending from said first end of the extension shaft, the distal end of the main shaft having a slot formed therein receiving the pivot block, a pair of bearing openings formed in said distal end in perpendicular intersecting relation to the slot, and the pivot block having stub axles extending therefrom into said bearing openings.

3. The invention of claim 1, wherein:

said means pivotally securing the first end of the extension shaft to the main shaft comprises a first pivot extension on said first end of said extension shaft, a mating second pivot extension on the main shaft, each of said pivot extensions having openings formed therein in co-axial relationship, and a pivot axle extending through said openings.

4. The invention of claim 1, wherein:

said means pivotally securing the first end of the extension shaft to the main shaft comprises a ball member extending from said first end of the extension shaft, the distal end of the main shaft having a socket formed therein, and said ball member being pivotally secured in said socket.

5. The invention of claim 1, wherein:

said bristles are of sequentially reduced lengths from the first end to the second end.

* * * * *